US010153078B2

(12) United States Patent
Yen et al.

(10) Patent No.: US 10,153,078 B2
(45) Date of Patent: Dec. 11, 2018

(54) INTEGRATED INDUCTOR STRUCTURE AND INTEGRATED TRANSFORMER STRUCTURE

(71) Applicant: Realtek Semiconductor Corporation, Hsinchu (TW)

(72) Inventors: Hsiao-Tsung Yen, Hsinchu (TW); Yuh-Sheng Jean, Hsinchu County (TW); Ta-Hsun Yeh, Hsinchu (TW)

(73) Assignee: REALTEK SEMICONDUCTOR CORPORATION, Hsinchu (TW)

( * ) Notice: Subject to any disclaimer, the term of this patent is extended or adjusted under 35 U.S.C. 154(b) by 0 days.

(21) Appl. No.: 15/269,756

(22) Filed: Sep. 19, 2016

(65) Prior Publication Data

US 2017/0098500 A1 Apr. 6, 2017

(30) Foreign Application Priority Data

Oct. 6, 2015 (TW) ..... 104132810 A

(51) Int. Cl.
*H01F 5/00* (2006.01)
*H01F 27/28* (2006.01)
(Continued)

(52) U.S. Cl.
CPC ..... *H01F 27/2804* (2013.01); *H01F 27/29* (2013.01); *H01F 2017/0073* (2013.01);
(Continued)

(58) Field of Classification Search
CPC ..... H01F 2017/0073
(Continued)

(56) References Cited

U.S. PATENT DOCUMENTS 6,577,219 B2 6/2003 Visser
6,603,383 B2 8/2003 Geborgian et al.
(Continued)

FOREIGN PATENT DOCUMENTS

CN 1522450 8/2004
CN 102376414 A 3/2012
(Continued)

OTHER PUBLICATIONS

State Intellectual Property Office of the People's Republic of China , "Office Action", dated Nov. 16, 2017.
(Continued)

*Primary Examiner* — Ronald Hinson
(74) *Attorney, Agent, or Firm* — WPAT, PC

(57) ABSTRACT

An integrated inductor structure includes a first spiral coil, a second spiral coil and a connection metal segment. The first spiral coil includes a plurality of metal segments, a bridging segment and first to fourth terminals. The bridging segment connects the metal segments. The second spiral coil has fifth and sixth terminals. The connecting metal segment connects the third and fifth terminals and the fourth and the sixth terminals. The integrated inductor structure uses the first and second terminals as its input and output terminals. The first and third terminals are on a first imaginary line, which passes a central region of a region surrounded by the first spiral coil. The bridging segment and the central region of the region are on a second imaginary line. An included angle between the two imaginary lines is equal to or greater than 45 degrees and equal to or smaller than 90 degrees.

14 Claims, 8 Drawing Sheets

⊠ through position

(51) Int. Cl.
*H01F 27/29* (2006.01)
*H01F 17/00* (2006.01)

(52) U.S. Cl.
CPC ..... *H01F 2027/2809* (2013.01); *H01F 2027/2819* (2013.01)

(58) Field of Classification Search
USPC ..... 336/200
See application file for complete search history.

(56) References Cited

U.S. PATENT DOCUMENTS

| | | | | |
|---|---|---|---|---|
| 6,653,910 | B2 | 11/2003 | Escalera et al. | |
| 7,642,891 | B2 * | 1/2010 | Einzinger ..... | H01F 17/0006 336/226 |
| 8,183,971 | B2 | 5/2012 | Le Guillou et al. | |
| 8,198,970 | B2 | 6/2012 | Choi et al. | |
| 8,305,182 | B1 | 11/2012 | Tsai et al. | |
| 8,536,969 | B2 | 9/2013 | Nam et al. | |
| 9,070,506 | B2 | 6/2015 | Anderson et al. | |
| 9,299,764 | B2 * | 3/2016 | Mattsson ..... | H01F 17/0006 |
| 9,312,060 | B2 | 4/2016 | Godoy et al. | |
| 2012/0044034 | A1 * | 2/2012 | Nazarian ..... | H01F 17/0013 336/200 |
| 2013/0141203 | A1 | 6/2013 | Yoon et al. | |
| 2015/0270054 | A1 | 9/2015 | Huang et al. | |

FOREIGN PATENT DOCUMENTS

| | | |
|---|---|---|
| CN | 102403097 A | 4/2012 |
| CN | 104769687 | 7/2015 |
| CN | 104769687 | 7/2016 |
| JP | 2005327931 | 11/2005 |
| TW | 201248658 | 12/2012 |

OTHER PUBLICATIONS

Taiwan Intellectual Property Office, TIPO, Office Action dated Feb. 2, 2018 in counterpart Taiwan application 105124973. Summary: The OA letter recites that TW201248658 and JP2005327931A render claims 1-3 obvious.
U.S. Appl. No. 15/150,126.
USPTO Office Action letter of U.S. Appl. No. 15/150,126 dated Aug. 9, 2018.
State Intellectual Property Office (SIPO) of the People's Republic of China, Office Action letter of related CN application of U.S. Appl. No. 15/150,126 dated Aug. 16, 2018. English summary on p. 1.

* cited by examiner

INTEGRATED INDUCTOR STRUCTURE AND INTEGRATED TRANSFORMER STRUCTURE

BACKGROUND OF THE INVENTION

1. Field of the Invention

The present invention relates to an integrated inductor structure and an integrated transformer structure, especially to a highly symmetric 8-shaped integrated inductor and integrated transformer.

2. Description of Related Art

Inductors and transformers are important elements in radio frequency integrated circuits to implement single-ended to differential signal conversion, signal coupling and impedance matching. As System-on-chips (SoC) become the mainstream of integrated circuits, integrated inductors and integrated transformers gradually substitute conventional discrete elements and are commonly applied to radio frequency integrated circuits. However, inductors and transformers in integrated circuits often take up large areas; therefore, it becomes an important issue to reduce the areas of inductors and transformers in integrated circuits without degrading element performances, such as inductance, quality factor (Q), and coupling coefficient (K).

FIG. 1 illustrates a structure of a conventional 8-shaped integrated inductor. An 8-shaped integrated inductor 100 comprises a spiral coil 110 and a spiral coil 120. The spiral coil 110 (120) comprises a metal segment 112 (122) and a metal segment 114 (124). The metal segment 112 (122) and the metal segment 114 (124) are connected by through structures at through positions. The through structures can be via structures or a via array. In operation, signals are inputted at one terminal 111 (or 121) of the 8-shaped integrated inductor 100 and outputted at the other terminal 121 (or 111). The 8-shaped integrated inductor 100 has an obvious drawback, that the spiral coil 110 or the spiral coil 120 itself has unsatisfactory symmetry, causing poor performances of the quality factor and the inductance of the 8-shaped integrated inductor 100. Moreover, the two terminals 111 and 121 of the 8-shaped integrated inductor 100 are distant from each other, such that the connection with differential elements in an integrated circuit becomes difficult (which becomes even more apparent as the numbers of turns of the spiral coils get greater).

SUMMARY OF THE INVENTION

In view of the issues of the prior art, an object of the present invention is to provide an integrated inductor structure and an integrated transformer structure to improve the symmetry and the inductance of inductors.

The present invention discloses an integrated inductor structure comprising a first spiral coil, a second spiral coil and a connecting metal segment. The first spiral coil comprises a plurality of metal segments and a bridging metal segment and has a first terminal, a second terminal, a third terminal and a fourth terminal. The bridging metal segment is for connecting the metal segments, and the bridging metal segment and the metal segments are implemented in different layers. The second spiral coil has a fifth terminal and a sixth terminal. The connecting metal segment connects the third terminal with the fifth terminal and connects the fourth terminal with the sixth terminal. The integrated inductor structure utilizes one of the first terminal and the second terminal as an input terminal and the other as an output terminal, the first terminal and the third terminal are on a first imaginary straight line, the first imaginary straight line passes a central region of a region surrounded by the first spiral coil, the bridging metal segment and the central region of the region are on a second imaginary straight line, and an included angle between the first imaginary straight line and the second imaginary straight line is equal to or greater than 45 degrees and equal to or smaller than 90 degrees.

The present invention also discloses an integrated transformer structure comprising a first spiral coil, a second spiral coil and a connecting metal segment. The first spiral coil comprises a plurality of metal segments and a bridging metal segment, and has a first terminal, a second terminal, a third terminal and a fourth terminal. The bridging metal segment is for connecting the metal segments and the bridging metal segment and the metal segments are implemented in different layers. The second spiral coil has a fifth terminal, a sixth terminal, a seventh terminal and an eighth terminal. The connecting metal segment, connects the third terminal with the fifth terminal and connects the fourth terminal with the sixth terminal. The integrated inductor structure utilizes the first terminal and the second terminal as an input port and the seventh terminal and the eighth terminal as an output port, the first terminal and the third terminal are on a first imaginary straight line, the first imaginary straight line passes a central region of a region surrounded by the first spiral coil, the bridging metal segment and the central region of the region are on a second imaginary straight line, and an included angle between the first imaginary straight line and the second imaginary straight line is equal to or greater than 45 degrees and equal to or smaller than 90 degrees.

The integrated inductor structures and the integrated transformer structures of this invention have high symmetry, which is beneficial to improving the inductance. In addition, because the distance between the input terminals of the inductor is not subject to the number of turns of the spiral coil, it is easy to connect the inductor with differential elements in the integrated circuit.

These and other objectives of the present invention no doubt becomes obvious to those of ordinary skill in the art after reading the following detailed description of the preferred embodiments with reference to the various figures and drawings.

DETAILED DESCRIPTION OF THE EMBODIMENTS

The following description is written by referring to terms of this technical field. If any term is defined in this specification, such term should be explained accordingly. In addition, the connection between objects or events in the below-described embodiments can be direct or indirect provided that these embodiments are practicable under such connection. Said "indirect" means that an intermediate object or a physical space exists between the objects, or an intermediate event or a time interval exists between the events.

Figure 1:
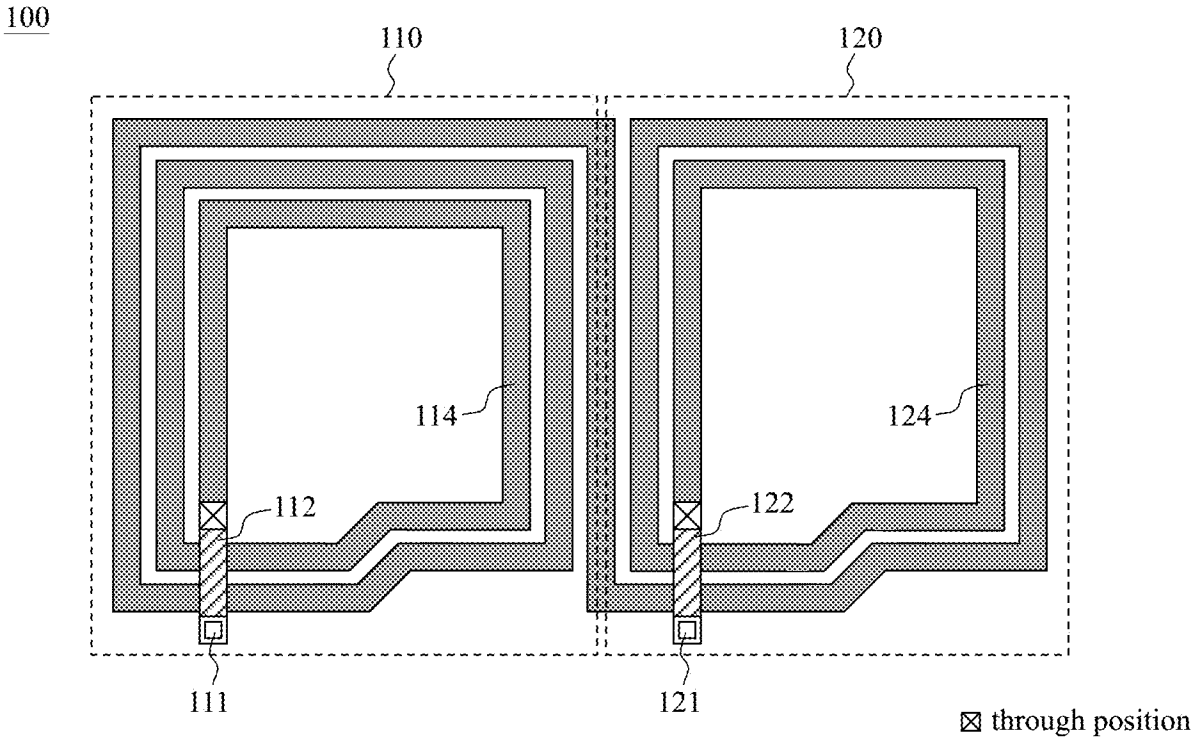
Fig. 1 (prior art)
FIG. 1 illustrates a structure of a conventional 8-shaped integrated inductor.
Figure 2:
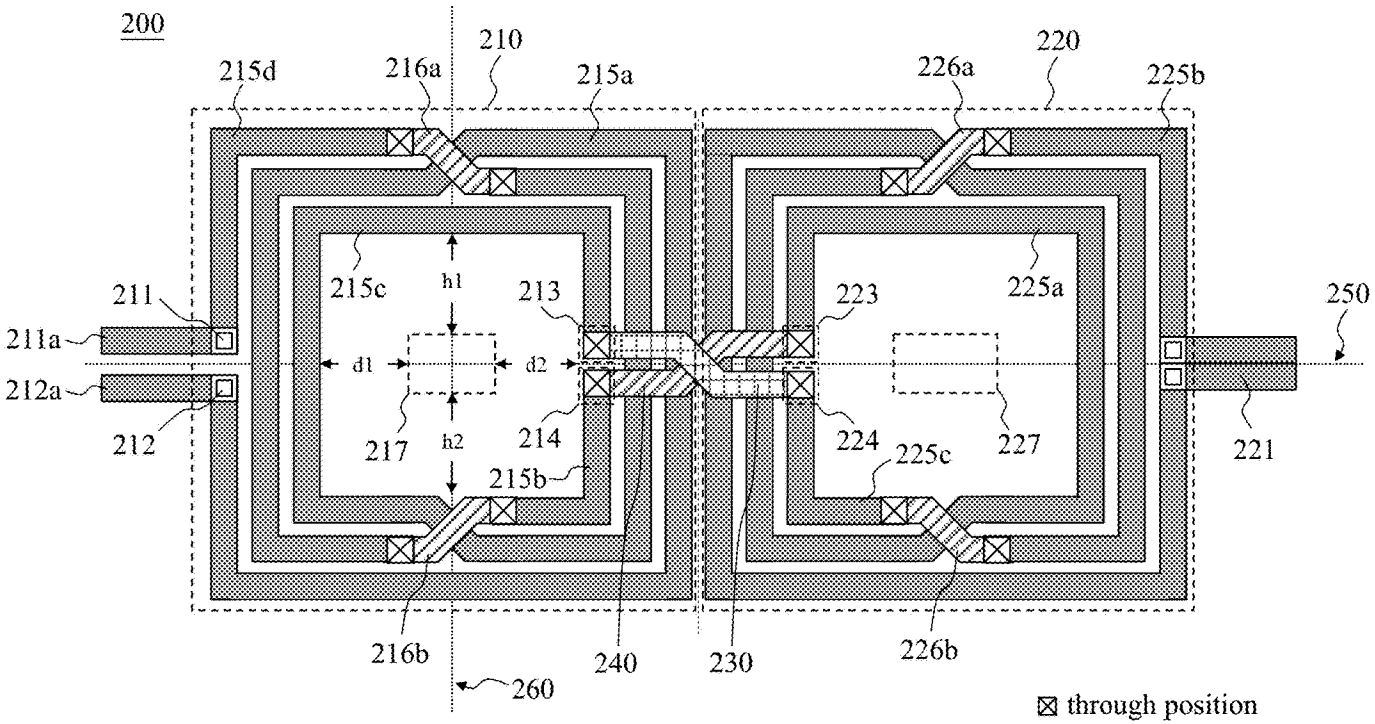
FIG. 2 illustrates a structure of an 8-shaped integrated inductor according to an embodiment of this invention.

FIG. 2 illustrates a structure of an 8-shaped integrated inductor according to an embodiment of this invention. The 8-shaped integrated inductor 200 comprises a spiral coil 210 and a spiral coil 220. The spiral coil 210 comprises metal segments 215*a*, 215*b*, 215*c* and 215*d*, implemented in the same metal layer and together forming a 3-turn structure. These four metal segments are connected by the bridging metal segments 216*a* and 216*b*, which are implemented in different metal layers. The spiral coil 210 comprises four terminals 211, 212, 213 and 214. One of the two terminals 211 and 212 is an input terminal of the 8-shaped integrated inductor 200, and the other is an output terminal. The two terminals transmit signals through the conducting metal segments 211*a* and 212*a* respectively. Similarly, the spiral coil 220 comprises metal segment 225*a*, 225*b* and 225*c*, implemented in the same metal layer and together forming a 3-turn structure. These three metal segments are connected by bridging metal segments 226*a* and 226*b*, which are implemented in different layers.

The terminals 211 and 212 are located at an outer coil of the spiral coil 210 while the terminals 213 and 214 are located at an innermost coil of the spiral coil 210. On the other hand, the terminals 223 and 224 are located at the innermost coil of the spiral coil 220. The spiral coil 210 and the spiral coil 220 are connected through a connecting metal segment, which comprises the bridging metal segments 230 and 240. The bridging metal segment 230 connects the terminal 213 and the terminal 224; the bridging metal segment 240 connects the terminal 214 and the terminal 223. In this embodiment, the metal segments of the spiral coil 210 and the spiral coil 220, except the bridging metal segments, are implemented in the first metal layer; the bridging metal segments 230 and 240, which are respectively implemented in the second metal layer and the third metal layer, form a crossing structure. Therefore, the bridging metal segments 230 and 240 can overpass multiple metal segments (located in the first metal layer) that constitute the spiral coil 210 and the spiral coil 220, such that the innermost coils of the spiral coil 210 and the spiral coil 220 are connected through the connecting metal segment. In another embodiment, the connecting metal segment may not be a crossing structure, i.e., one of the bridging metal segments connects the terminal 213 and the terminal 223 while the other bridging metal segment connects the terminal 214 and the terminal 224. In this case the connecting metal segment can be implemented in a single metal layer.

In fact, both the spiral coil 210 and the spiral coil 220 are symmetric spiral coils and are in a back-to-back arrangement. After the terminals located at the inner coils of the spiral coil 210 and the spiral coil 220 (i.e., the terminals 213, 214, 223 and 224) are connected via the connecting metal segment, an 8-shaped integrated inductor structure is formed. A central tap 221 of the 8-shaped integrated inductor 200 can be formed at the spiral coil 220 at a position corresponding to the terminals 211 and 212 of the spiral coil 210. As a result, a port of the 8-shaped integrated inductor 200 (the port is formed by the terminal 211 and the terminal 212), the connecting metal segment and the central tap 221 are on one straight line 250, and the 8-shaped integrated inductor 200 is symmetric with respective to the straight line 250. Therefore, the 8-shaped integrated inductor 200 of this invention has better symmetry as opposed to the conventional 8-shaped integrated inductor 100, and the distance between the terminal 211 and the terminal 212 is reduced and is not subject to the number of turns of the spiral coil, hence making the 8-shaped integrated inductor 200 more suitable for differential circuits. When the 8-shaped integrated inductor 200 is applied to a differential circuit, the central tap 221 can be connected to the ground or a voltage source VDD of the differential circuit.

The region surrounded by the spiral coil 210 includes a central region 217 (similarly, the spiral coil 220 includes a central region 227). The central region 217 is approximately located in the center of the innermost coil of the spiral coil 210; that is, the distances h1 and h2 between the central region 217 and its upper and lower metal segments are approximately equal, and the distances d1 and d2 between the central region 217 and its left and right metal segments are approximately the same. In this embodiment, the bridging metal segments 216*a* and 216*b* are located on the sides of the spiral coil 210 parallel to the straight line 250. In other words, the straight line 250 does not pass the bridging metal segments 216*a* and 216*b*. However, when the spiral coil 210 is not implemented as a rectangle (for example, implemented as other polygons or even as a circle), the position of the bridging metal segment 216*a* (or 216*b*) can be further defined as the following. For the spiral coil 210, a first imaginary straight line can be formed by connecting the first terminal or the second terminal with the third terminal or the fourth terminal (i.e., approximately the straight line 250), and a second imaginary straight line can be formed by connecting the bridging metal segment 216*a* (or 216*b*) with the central region 217 of the region surrounded by the spiral coil 210 (i.e., approximately the straight line 260). An included angle (taking the smaller one as the subject for discussion) formed by the two imaginary straight lines can be equal to or greater than 45 degrees and equal to or smaller than 90 degrees (in the embodiment of FIG. 2 this angle being substantially 90 degrees). In this design, the 8-shaped integrated inductor 200 takes up three metal layers at most when the connecting metal segment is a crossing structure as shown in FIG. 2; However, if the bridging metal segment 216*a* (or 216*b*) is located on or close to the straight line 250, the 8-shaped integrated inductor 200 needs to take up four metal layers; that is, the connecting metal segment, which is a crossing structure, must be made in a third and fourth metal layers in order to overpass multiple metal segments (the first metal layer) and the bridging metal segment 216*a* (216*b*) (the second metal layer) of the spiral coil 210 at the same time.

Figure 3A:
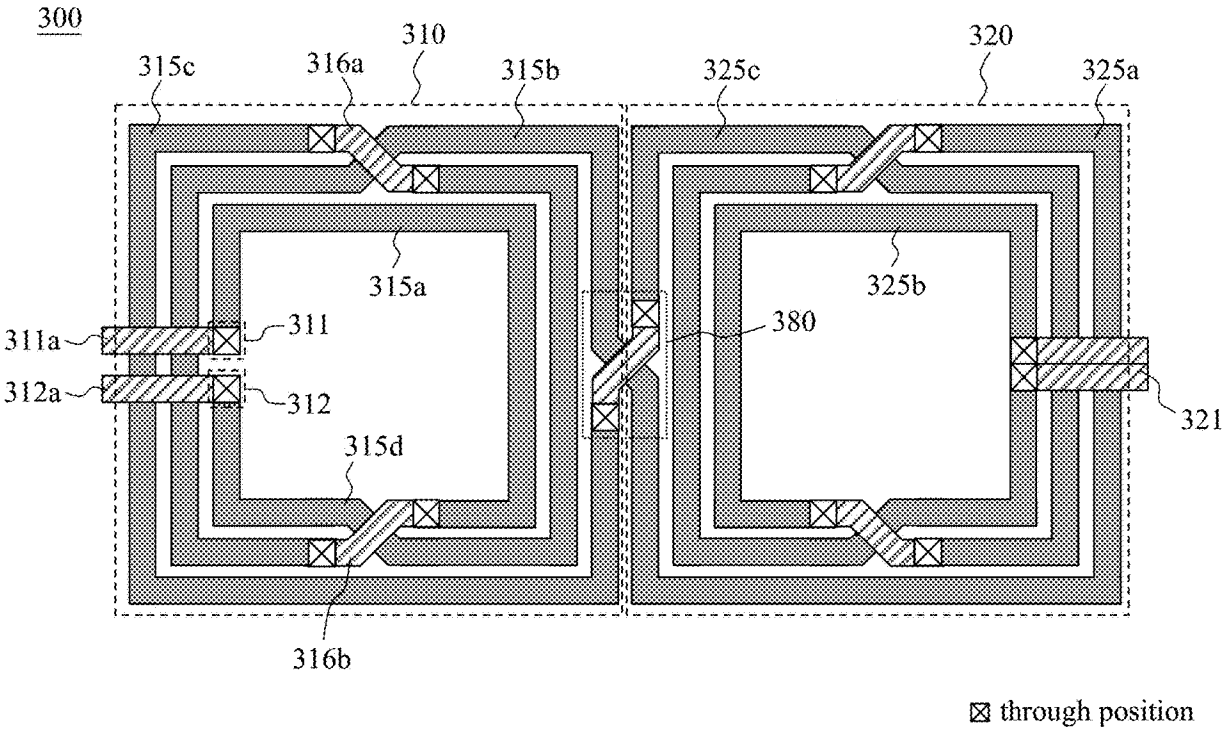
FIG. 3A illustrates a structure of an 8-shaped integrated inductor according to another embodiment of this invention.

FIG. 3A illustrates a structure of an 8-shaped integrated inductor according to another embodiment of this invention. The 8-shaped integrated inductor 300 comprises a spiral coil 310 and a spiral coil 320. The spiral coil 310 comprises metal segments 315*a*, 315*b*, 315*c* and 315*d*, implemented in the same metal layer and together forming a 3-turn structure. The four metal segments are connected by bridging metal segments 316*a* and 316*b*. The spiral coil 310 comprises terminals 311 and 312, one of which is an input terminal of the 8-shaped integrated inductor 300 and the other is an output terminal. The two terminals transmit signals through the conducting metal segments 311*a* and 312*a* respectively. Similarly, the spiral coil 320 comprises metal segments 325*a*, 325*b* and 325*c*, implemented in the same metal layer and together forming a 3-turn structure. The three metal segments are connected by the bridging metal segments.

Similar to the embodiment shown in FIG. 2, the spiral coil 310 and the spiral coil 320 are both symmetric spiral coils and are in a back-to-back arrangement. They are connected by the connecting metal segment 380. The arrangement of the bridging metal segment is the same as that of the spiral coil 210 or the spiral coil 220. The two embodiments are different in that the terminals 311 and 312 are located at the innermost coil of the spiral coil 310, and so the conducting metal segments 311*a* and 312*a* are implemented in a different metal layer. In this embodiment, the conducting metal segments 311*a* and 312*a* are located above the metal layer at which the metal segments 315*a*, 315*b*, 315*c* and 315*d* are located. Because the spiral coils 320 and 310 are symmetric to each other, the central tap 321 is similarly located above the metal layer at which the metal segments 325*a*, 325*b* and 325*c* are located.

Figure 3B:
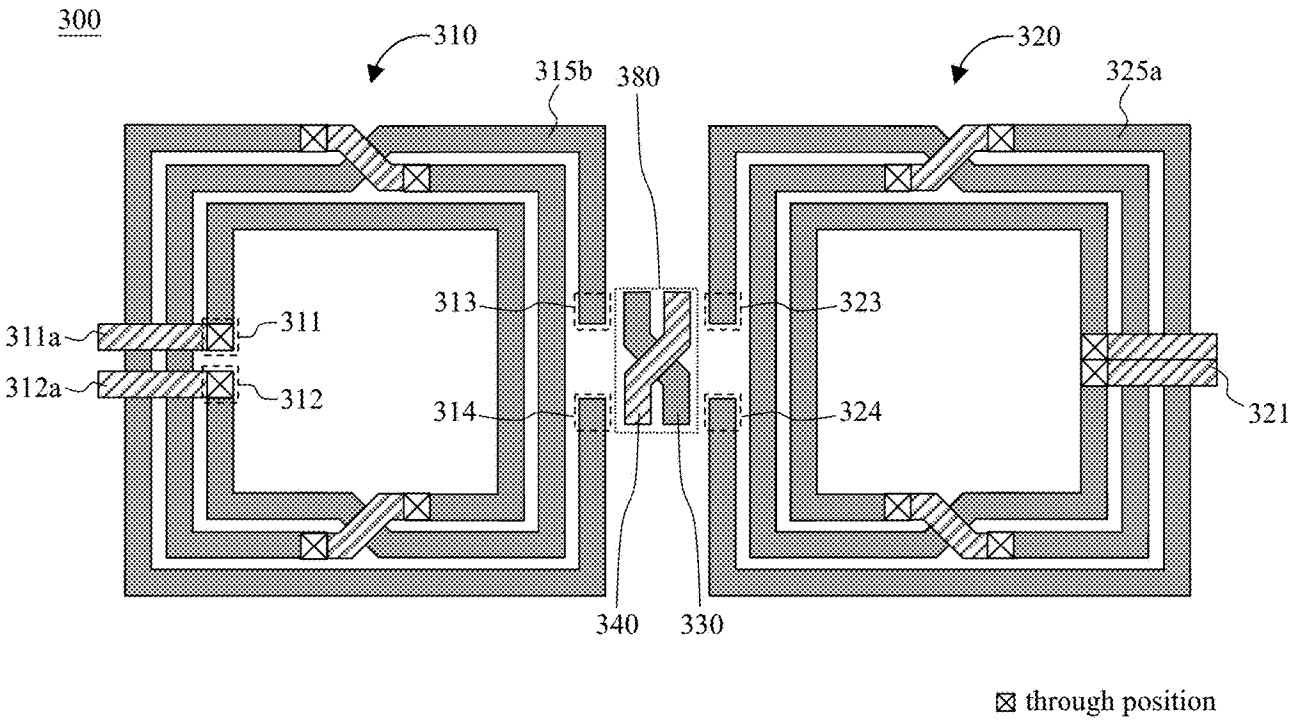
FIG. 3B depicts the respective structures of these three components.

To better illustrate the connections among the terminals of the spiral coil 310 and spiral coil 320 and the connecting metal segment 380 in more detail, FIG. 3B depicts the respective structures of these three components. In addition to the terminals 311 and 312, the spiral coil 310 further comprises terminals 313 and 314, both located at the outer coil of the spiral coil 310. Similarly, the spiral coil 320 comprises terminals 323 and 324, both locate at the outer coil of the spiral coil 320. The connecting metal segment 380 comprises an extension metal segment 330 and a bridging metal segment 340. The extension metal segment 330 connects the terminal 313 and the terminal 324, and the bridging metal segment 340 connects the terminal 314 and the terminal 323. The extension metal segment 330 and the metal segments 315*b* and 325*a* are located in the same metal layer. Thus, in one embodiment, the extension metal segment 330 can be considered an extension of the metal segment 315*b* and/or the metal segment 325*a*; in other words, the metal segment 315*b*, the extension metal segment 330 and the metal segment 325*a* are a continuous metal segment. Therefore, the connecting metal segment 380 can be considered to comprise the bridging metal segment 340 only. However, the extension metal segment 330 is defined as an independent metal segment in this embodiment for the purpose of better describing the connections among the terminals of the spiral coils 310 and 320. As opposed to the structure shown in FIG. 2, the terminals through which the spiral coil 310 and the spiral coil 320 are connected are implemented on the outer coil of their respective spiral coils, in a way that it is not necessary for the connecting metal segment 380 to overpass the metal segments of the spiral coils 310 and 320. Thus, the manufacturing process of the connecting metal segment 380 can be simplified so that the number of total metal layers required to implement the 8-shaped integrated inductor 300 is not greater than two. Because the terminals 311 and 312 are implemented at the innermost coil and the number of turns of the spiral coil 310 of this embodiment is an odd number, the conducting metal segment 311*a* and 312*a* do not overlap the central region of the region surrounded by the spiral coil 310. Similarly, the central tap 321 of the spiral coil 320 does not overlap the central region of the region surrounded by the spiral coil 320.

Figure 4:
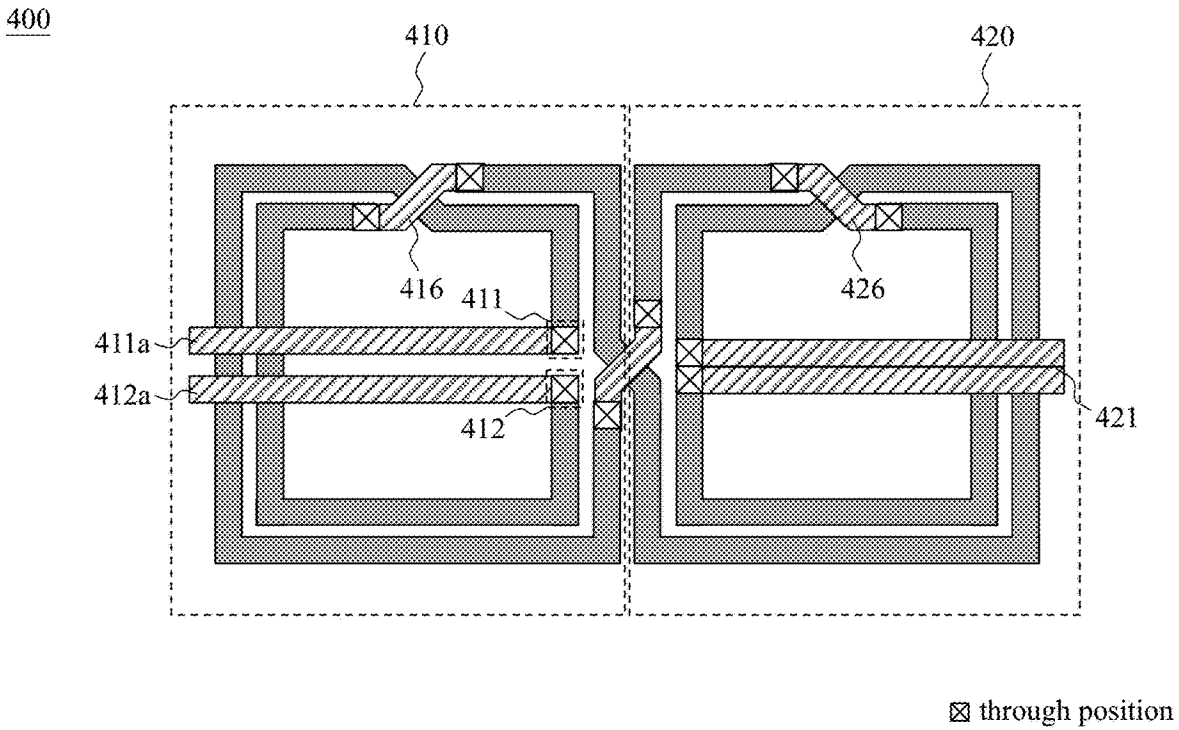
FIG. 4 illustrates a structure of an 8-shaped integrated inductor according to another embodiment of this invention.
Figure 5:
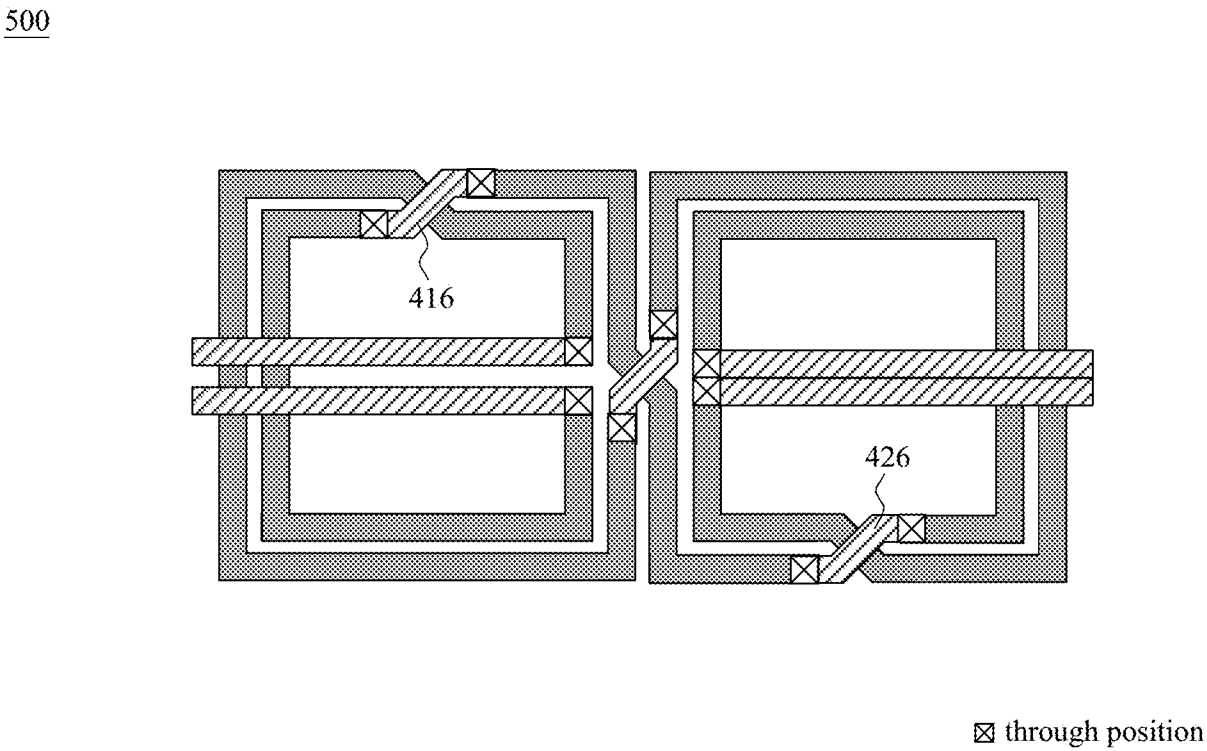
FIG. 5 illustrates a structure of an 8-shaped integrated inductor according to another embodiment of this invention.

FIG. 4 illustrates a structure of an 8-shaped integrated inductor according to another embodiment of this invention. The 8-shaped integrated inductor 400 comprises the spirals coil 410 and 420. In this embodiment, both the spiral coils 410 and 420 are in even turns, the terminals 411 and 412 of the spiral coil 410 are located at the inner coil, and the conducting metal segments 411*a* and 412*a* overlap the central region of the region surrounded by the spiral coil 410. Similarly, the central tap 421 overlaps the central region of the region surrounded by the spiral coil 420. In FIG. 4, the bridging metal segment 416 of the spiral coil 410 and the bridging metal segment 426 of the spiral coil 420 are on the same side of the 8-shaped integrated inductor 400. In an another embodiment, the bridging metal segment 416 and the bridging metal segment 426 can be on different sides of the 8-shaped integrated inductor 500, as shown in FIG. 5.

Figure 6:
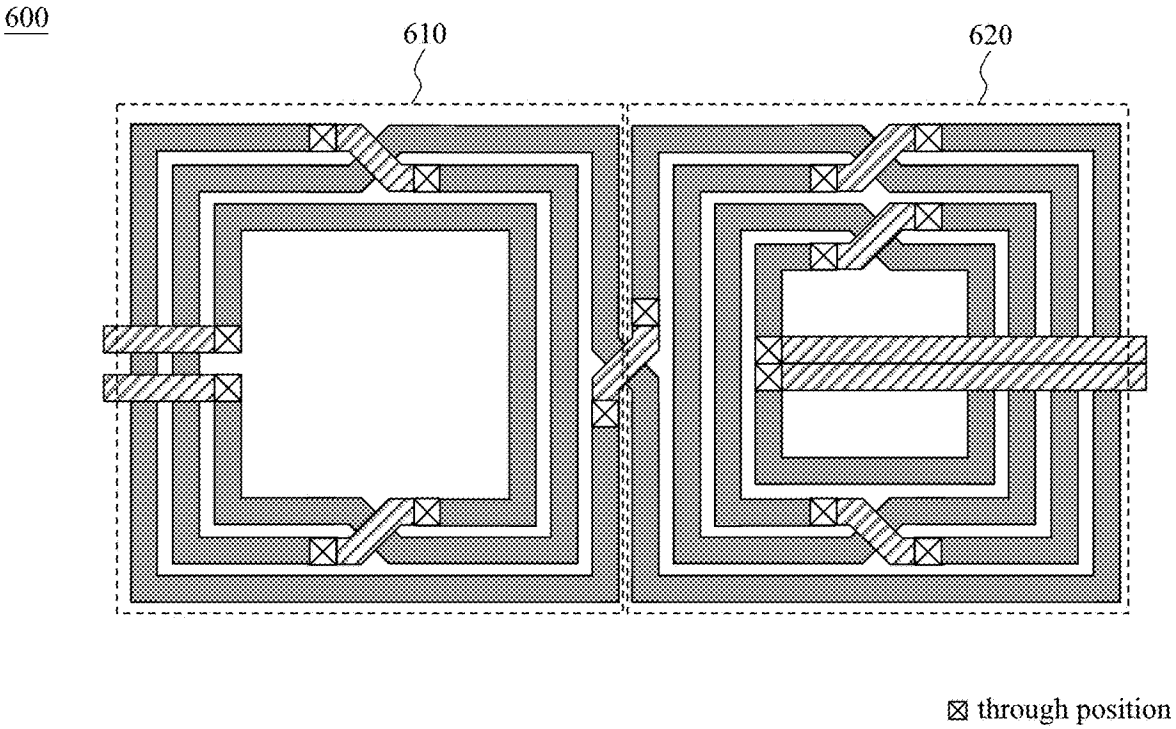
FIG. 6 illustrates a structure of an 8-shaped integrated inductor according to another embodiment of this invention.

FIG. 6 illustrates a structure of an 8-shaped integrated inductor according to another embodiment of this invention. The 8-shaped integrated inductor 600 comprises spiral coils 610 and 620. The spiral coil 610 has odd turns while the spiral coil 620 has even turns. In other words, the two spiral coils of the 8-shaped integrated inductor of this invention are neither limited to having the same number of turns nor limited to a combination of both including even turns or both including odd turns.

For the 8-shaped integrated inductors in FIGS. 2 to 6, the current in one of the two spiral coils flows clockwise whereas the current in the other flows counterclockwise, resulting in a great magnetic coupling effect that reduces magnetic radiation, such that other components near the 8-shaped integrated inductors are less influenced.

Figure 7:
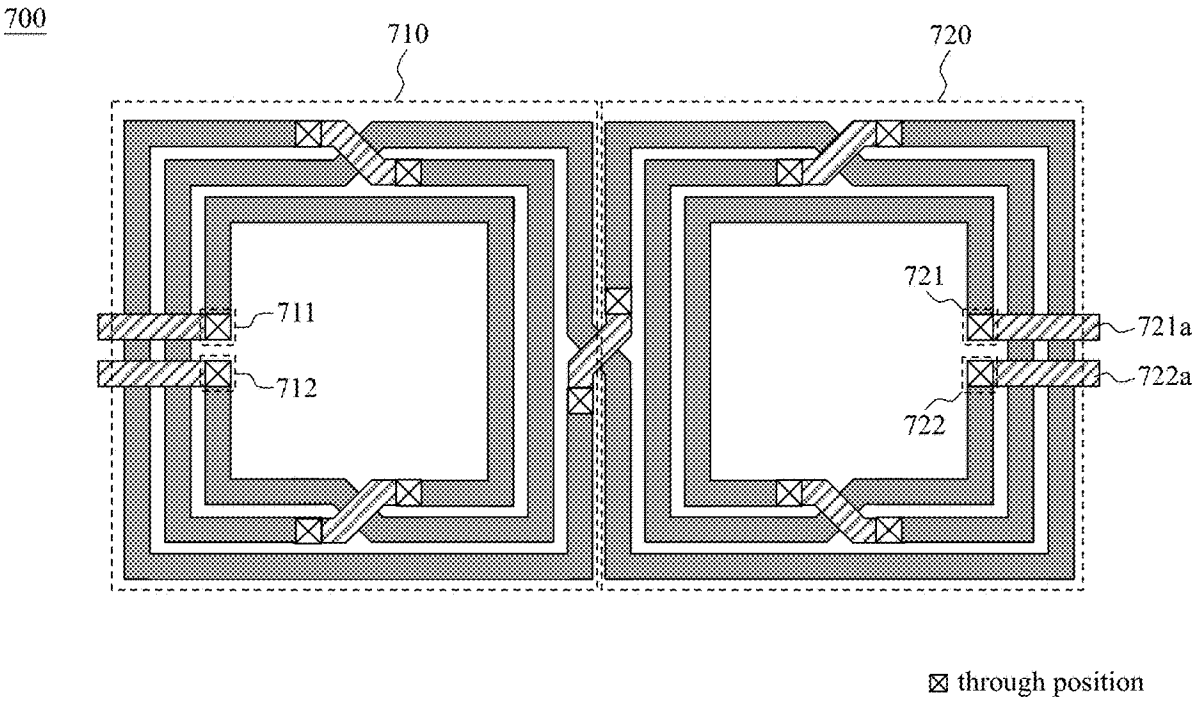
FIG. 7 illustrates a structure of an integrated transformer according to an embodiment of this invention.

In addition to the aforementioned 8-shaped integrated inductors, this invention also discloses an integrated transformer structure. The integrated transformer structure is formed by modifying the central tap of the 8-shaped integrated inductor in each of the FIGS. 2 to 6 into two terminals, which are the output port of the integrated transformer. Further, the original input terminal and the output terminal of the 8-shaped integrated inductor become the input port of the integrated transformer. Taking the 8-shaped integrated inductor shown in FIG. 3A for example, its corresponding transformer is illustrated in FIG. 7. The integrated transformer 700 comprises two spiral coils 710 and 720. The spiral coil 710 is identical to the spiral coil 310, and both comprise four terminals. The spiral coil 720 comprises four terminals as well; two of them are located at the outer coil (analogous to the terminals 323 and 324 in FIG. 3B) and are connected to two terminals of the spiral coil 710 through the connecting metal segment, and the other two terminals, the terminals 721 and 722, form one port of the integrated transformer 700 (the other port being formed by the terminals 711 and 712) and transmit signals through the conducting metal segments 721*a* and 722*a* respectively.

In addition to the method described above, the integrated transformer of this invention can be implemented by duplicating any of the 8-shaped integrated inductors in FIGS. 2 to 6 in other metal layers, in a way that the two 8-shaped integrated inductors are overlapped in the vertical direction to realize the functionality of the transformer by the magnetic coupling between the two inductors. When two 8-shaped integrated inductors are used to implement the integrated transformer, the central tap of each 8-shaped integrated inductor can be omitted. Moreover, the bridging metal segments of the two 8-shaped integrated inductors can be implemented in the same metal layer to reduce the total number of metal layers required. Taking the 8-shaped integrated inductor 300 of FIG. 3A for example, when two 8-shaped integrated inductors are perfectly aligned in the vertical direction, four metal layers are required to implement the integrated transformer (each 8-shaped integrated inductor taking up two metal layers). However, if the bridging metal segments of the two 8-shaped integrated inductors are staggered by, for example, making the bridging metal segment of one of the two 8-shaped integrated inductors away from the connecting metal segment 380 and meanwhile making the bridging metal segment of the other 8-shaped integrated inductor close to the connecting metal segment 380, then the bridging metal segments of the two 8-shaped integrated inductors can be implemented in the same metal layer at the same time. As a result, the integrated transformer requires only three metal layers. In still another embodiment, the two 8-shaped integrated inductors can be respectively implemented in two dies of a three-dimensional (3D) chip. The two dies are face-to-face and each 8-shaped integrated inductor is disposed in the vertically-stacked dies to form a transformer structure. The space between the two dies is filled with an under-fill.

Note that although the bridging metal segments in FIGS. 2 to 7 are implemented in the upper metal layer (as opposed to the metal layer where most metal segments of the spiral coils are implemented), the bridging metal segments can be implemented in the lower metal layer.

The shape, size, and ratio of any element in the disclosed figures are exemplary for understanding, not for limiting the scope of this invention. The aforementioned descriptions represent merely the preferred embodiments of the present invention, without any intention to limit the scope of the present invention thereto. Various equivalent changes, alterations, or modifications based on the claims of the present invention are all consequently viewed as being embraced by the scope of the present invention.

What is claimed is:

1. An integrated inductor structure, comprising:

a first spiral coil, comprising a plurality of metal segments and a bridging metal segment, having a first terminal, a second terminal, a third terminal and a fourth terminal, wherein the bridging metal segment is for connecting the metal segments, and the bridging metal segment and the metal segments are implemented in different layers;

a second spiral coil, having a fifth terminal and a sixth terminal; and a connecting metal segment, connecting the third terminal with the fifth terminal and connecting the fourth terminal with the sixth terminal;

wherein, the integrated inductor structure utilizes one of the first terminal and the second terminal as an input terminal and the other as an output terminal, the first terminal and the third terminal are on a first imaginary straight line, the first imaginary straight line passes a central region of a region surrounded by the first spiral coil, the bridging metal segment and the central region of the region are on a second imaginary straight line, and an included angle between the first imaginary straight line and the second imaginary straight line is equal to or greater than 45 degrees and equal to or smaller than 90 degrees;

wherein the first spiral coil comprises a first outer coil and at least one first inner coil, the second spiral coil comprises a second outer coil and at least one second inner coil, the first terminal and the second terminal are located at the first inner coil, the third terminal and the fourth terminal are located at the first outer coil, and the fifth terminal and the sixth terminal are located at the second outer coil;

wherein the first terminal and the second terminal transmit signals through a first conducting metal segment and a second conducting metal segment, respectively, the first conducting metal segment and the second conducting metal segment overpass the metal segments, and the first conducting metal segment and the second conducting metal segment do not overlap the region when the number of turns of the first spiral coil is an odd number.

2. The integrated inductor structure of claim 1, wherein the metal segments are implemented in a first metal layer, the second spiral coil comprises a plurality of additional metal segments implemented in the first metal layer, the connecting metal segment comprises an extension metal segment and a bridging metal segment respectively implemented in the first metal layer and a second metal layer, and the bridging metal segment overpasses the extension metal segment but does not overpass the metal segments and the additional metal segments.

3. The integrated inductor structure of claim 1, wherein the first terminal and the second terminal transmit signal through a first conducting metal segment and a second conducting metal segment respectively, the first conducting metal segment and the second conducting metal segment overpass the metal segments, and the first conducting metal segment and the second conducting metal segment overlap the region when the number of turns of the first spiral coil is an even number.

4. The integrated inductor structure of claim 1, wherein the first spiral coil and the second spiral coil have different numbers of turns.

5. The integrated inductor structure of claim 1, wherein the included angle is substantially 90 degrees.

6. The integrated inductor structure of claim 1, wherein the first spiral coil comprises a first outer coil and at least one first inner coil, the second spiral coil comprises a second outer coil and at least one second inner coil, the first terminal and the second terminal are located at the first outer coil, the third terminal and the fourth terminal are located at the first inner coil, and the fifth terminal and the sixth terminal are located at the second inner coil.

7. The integrated inductor structure of claim 6, wherein the metal segment is implemented in a first metal layer, the second spiral coil comprises a plurality of additional metal segments implemented in the first metal layer, the connecting metal segment comprises a first bridging metal segment and a second bridging metal segment respectively implemented in a second metal layer and a third metal layer, and the first bridging metal segment and the second bridging metal segment overpass a part of the metal segments and a part of the additional metal segments.

8. An integrated transformer structure, comprising:

a first spiral coil, comprising a plurality of metal segments and a bridging metal segment, and having a first terminal, a second terminal, a third terminal and a fourth terminal, wherein the bridging metal segment is for connecting the metal segments and the bridging metal segment and the metal segments are implemented in different layers;

a second spiral coil, having a fifth terminal, a sixth terminal, a seventh terminal and an eighth terminal; and a connecting metal segment, connecting the third terminal with the fifth terminal and connecting the fourth terminal with the sixth terminal;

wherein the integrated transformer structure utilizes the first terminal and the second terminal as an input port and the seventh terminal and the eighth terminal as an output port, the first terminal and the third terminal are on a first imaginary straight line, the first imaginary straight line passes a central region of a region surrounded by the first spiral coil, the bridging metal segment and the central region of the region are on a second imaginary straight line, and an included angle between the first imaginary straight line and the second imaginary straight line is equal to or greater than 45 degrees and equal to or smaller than 90 degrees;

wherein the first spiral coil comprises a first outer coil and at least one first inner coil, the second spiral coil comprises a second outer coil and at least one second inner coil, the first terminal and the second terminal are located at the first inner coil, the third terminal and the fourth terminal are located at the first outer coil, and the fifth terminal and the sixth terminal are located at the second outer coil;

wherein the first terminal and the second terminal transmit signals through a first conducting metal segment and a second conducting metal segment respectively, the first conducting metal segment and the second conducting metal segment overpass the metal segments, and the first conducting metal segment and the second conducting metal segment do not overlap the region when the number of turns of the first spiral coil is an odd number.

9. The integrated transformer structure of claim 8, wherein the metal segments are implemented in a first metal layer, the second spiral coil comprises a plurality of additional metal segments implemented in the first metal layer, the connecting metal segment comprises an extension metal segment and a bridging metal segment respectively implemented in the first metal layer and a second metal layer, and the bridging metal segment overpasses the extension metal segment but does not overpass the metal segments and the additional metal segments.

10. The integrated transformer structure of claim 8, wherein the first terminal and the second terminal transmit signal through a first conducting metal segment and a second conducting metal segment, respectively, the first conducting metal segment and the second conducting metal segment overpass the metal segments, and the first conducting metal segment and the second conducting metal segment overlap the region when the number of turns of the first spiral coil is an even number.

11. The integrated transformer structure of claim 8, wherein the first spiral coil and the second spiral coil have different numbers of turns.

12. The integrated transformer structure of claim 8, wherein the included angle is substantially 90 degrees.

13. The integrated transformer structure of claim 8, wherein the first spiral coil comprises a first outer coil and at least one first inner coil, and the second spiral coil comprises a second outer coil and at least one second inner coil, the first terminal and the second terminal are located at the first outer coil, the third terminal and the fourth terminal are located at the first inner coil, and the fifth terminal and the sixth terminal are located at the second inner coil.

14. The integrated transformer structure of claim 13, wherein the metal segment is implemented in a first metal layer, the second spiral coil comprises a plurality of additional metal segments implemented in the first metal layer, the connecting metal segment comprises a first bridging metal segment and a second bridging metal segment respectively implemented in a second metal layer and a third metal layer, and the first bridging metal segment and the second bridging metal segment overpass a part of the metal segments and a part of the additional metal segments.

* * * * *